US006644522B2

(12) United States Patent
Preiss

(10) Patent No.: US 6,644,522 B2
(45) Date of Patent: Nov. 11, 2003

(54) CUSHION SYSTEM AND DEVICE

(76) Inventor: David L. Preiss, 2375 Holly Oak Dr., Danville, CA (US) 94506

( * ) Notice: Subject to any disclaimer, the term of this patent is extended or adjusted under 35 U.S.C. 154(b) by 9 days.

(21) Appl. No.: 09/953,984

(22) Filed: Sep. 10, 2001

(65) Prior Publication Data

US 2002/0134805 A1 Sep. 26, 2002

Related U.S. Application Data

(60) Provisional application No. 60/274,502, filed on Mar. 8, 2001.

(51) Int. Cl.[7] ..... A45F 3/12
(52) U.S. Cl. ..... 224/264; 224/643
(58) Field of Search ..... 224/264, 642, 224/643

(56) References Cited

U.S. PATENT DOCUMENTS

| | | | | |
|---|---|---|---|---|
| 3,883,053 A | 5/1975 | Pritchard et al. | ..... | 245/5 P |
| 4,756,311 A | 7/1988 | Francis, Jr. | ..... | 128/403 |
| 5,393,462 A | 2/1995 | Avery | ..... | 252/315.5 |
| 5,507,422 A | 4/1996 | Shields | ..... | 224/264 |
| 5,555,584 A | 9/1996 | Moore, III et al. | ..... | 12/142 N |
| 5,566,871 A | 10/1996 | Weintraub | ..... | 224/264 |
| 5,577,648 A | 11/1996 | Sason et al. | ..... | 224/637 |
| 6,109,495 A | 8/2000 | Hernandez | ..... | 224/644 |
| 6,141,801 A | 11/2000 | Helenick | ..... | 2/159 |
| 6,161,240 A | 12/2000 | Huang | ..... | 5/710 |

*Primary Examiner*—Stephen K. Cronin
(74) *Attorney, Agent, or Firm*—Haverstock & Owens LLP

(57) ABSTRACT

The system and device of the instant invention utilize a cushion section to distribute a load from a load bearing strap to a contact region of a user's body. The cushion section utilizes a fluid container or gel-pack. Preferably, the gel-pack is configured to selectively and detachably couple to the strap. Accordingly, the device has a supporting frame for supporting the gel-pack and two attaching sections with clips for selectively and detachably coupling the device to the strap. The device can be configured to couple to any number of straps, including restraining and supporting straps, but is preferably configured to couple to the shoulder strap of a backpack, a tote bag, a brief case, a piece of luggage, a golf bag a purse or other portable object.

40 Claims, 9 Drawing Sheets

CUSHION SYSTEM AND DEVICE

RELATED APPLICATION(S)

This patent application claims priority under 35 U.S.C. 119 (e) of the co-pending U.S. Provisional Patent Application, Serial No. 60/274,502, filed Mar. 8, 2001, and entitled "CUSHION SYSTEM, DEVICE AND METHOD". The Provisional Patent Application, Serial No. 60/274,502, filed Mar. 8, 2001, and entitled "CUSHION SYSTEM, DEVICE AND METHOD" is also hereby incorporated by reference.

FIELD OF THE INVENTION

This invention relates to the of field cushions. More particularly, this invention relates to systems and devices for cushioning load bearing straps and belts.

BACKGROUND

Strap and belt devices are common features of portable objects such as backpacks, tote bags, brief cases, luggage, golf bags, purses and the like. Strap and belt devices are also typically used for restraining passengers in motor vehicles and for supporting patients during transport. Sustaining excessive weight, force or impact through strap and belt devices can result in extended or acute orthopedic problems for the user. Further, regions of the user's body where a strap or belt device contacts or applies excessive force with a high degree of frequency can experience abrasion, bruising and/or even nerve damage. What is needed is a device that can ergonomically distribute a load bearing weight through a strap or belt device. Further, what is needed is a device that can potentially reduce trauma and provides comfort to regions of the user's body where the load bearing weight is frequently supported or where impact occurs through a strap or belt device.

SUMMARY OF THE INVENTION

The current invention is directed to a system and a device for providing cushion to a contact region of a user's body. The device comprises a cushion section and is configured to couple to one or more load bearing straps. Preferably, the device of the instant invention provides for ergonomic distribution of the load to the contact region of a user's body. The device is preferably configured to be selectively positioned with the cushion section between the contact region of the user's body and the one or more load bearing straps. Alternatively, the device is configured to couple through ends of load bearing straps.

In accordance with the system of the instant invention, at least one strap is configured for bearing a load. The strap can be attached and/or is attachable to an object which provides the load. The object is preferably a portable bag structure such as a backpack, a tote bag, a brief case, a piece of luggage, a golf bag or a purse, wherein the strap is placed over a user's shoulder. Alternatively, the at least one strap is a seat belt strap or any other restraining or support strap such as a sling strap for supporting an injured arm. The system also has a cushion section coupled to the at least one strap to provide distribution of the load over a contact region of the user's body.

The cushion section, in the system and the device of the instant invention, comprises a fluid container for providing cushion. The fluid container preferably comprises a liquid or a solution sealed within a flexible membrane. The flexible membrane comprises a single fluid compartment or, alternatively, comprises a plurality of fluid compartments. The fluid is preferably a liquid with a viscosity in a range of 0.5 to 25,000 centa-poise (cP) and more preferably in a range of 50.0 to 20,000 centa-poise (cP) at temperatures between 20 to 25 degrees Celsius. The fluid is any suitable fluid, but is preferably is a water-based solution of ethylene glycol with preservative and coloring additives. Alternatively, the fluid is gel such as a silicon-based gel or other suspension material. A fluid container which comprises a liquid, a solution, a gel suspension or a combination thereof, sealed within a flexible membrane, is referred to herein as a gel-pack.

Preferably the gel-pack is securable to the strap in an elongation direction of the strap such that the gel-pack will not slide up or down along the strap during use. In accordance with this preferred embodiment, the gel-pack is configured to be detachable from the strap through one or more attaching sections. Alternatively, the gel-pack is configured to be held within a pocket or container feature. In yet further embodiments, the gel-pack is integral with the strap, wherein the gel-pack is fixed within the fabric or the material of the strap.

The device of the instant invention preferably comprises two or more attaching sections for selectively and detachably coupling to a shoulder strap. One or more of the attaching sections can be configured to be expandable. The expandable section is formed with a flexible material and/or with a resilient accordion-like structure, which allows the cushion section to remain substantially in position while an attached strap flexes or twists.

The attaching sections of the device preferably each comprise a clips which clasp the strap and which holds the device in a selected position. The clips can have any suitable design, such as a two-slot three-prong slide clip, but are preferably two-part clips configured to clasp around a strap. For example, the clips comprise arm structures protruding from first clip parts, wherein the arm structures have corrugated edges. Second clip parts comprise receiving apertures. In use, the arm structures insert into receiving apertures with a strap between the first clip parts and the second clip parts. The corrugated edges of the arm structures ratchet into the receiving apertures and clasps around the strap securing the device to the strap.

The attaching sections are preferably coupled to the gel-pack through a support frame. The support frame preferably frames the gel-pack through a framing region, such that surfaces of the gel-pack are exposed and protrude from two opposite sides of the support frame. The support frame is monolithic with a framing groove between framing flaps wherein a securing edge of the gel-pack is inserted into the framing grove and secured between the securing flaps. Alternatively, the frame is formed in parts with two or more framing sections, wherein the framing sections sandwich the securing edge of the gel-pack to hold the gel-pack within the support frame. The support frame preferably comprises prong or rivet structures which thread through the securing edge of the gel-pack and help to hold and secure the gel-pack in the framing region.

DETAILED DESCRIPTION OF THE PREFERRED EMBODIMENT

Figure 1:
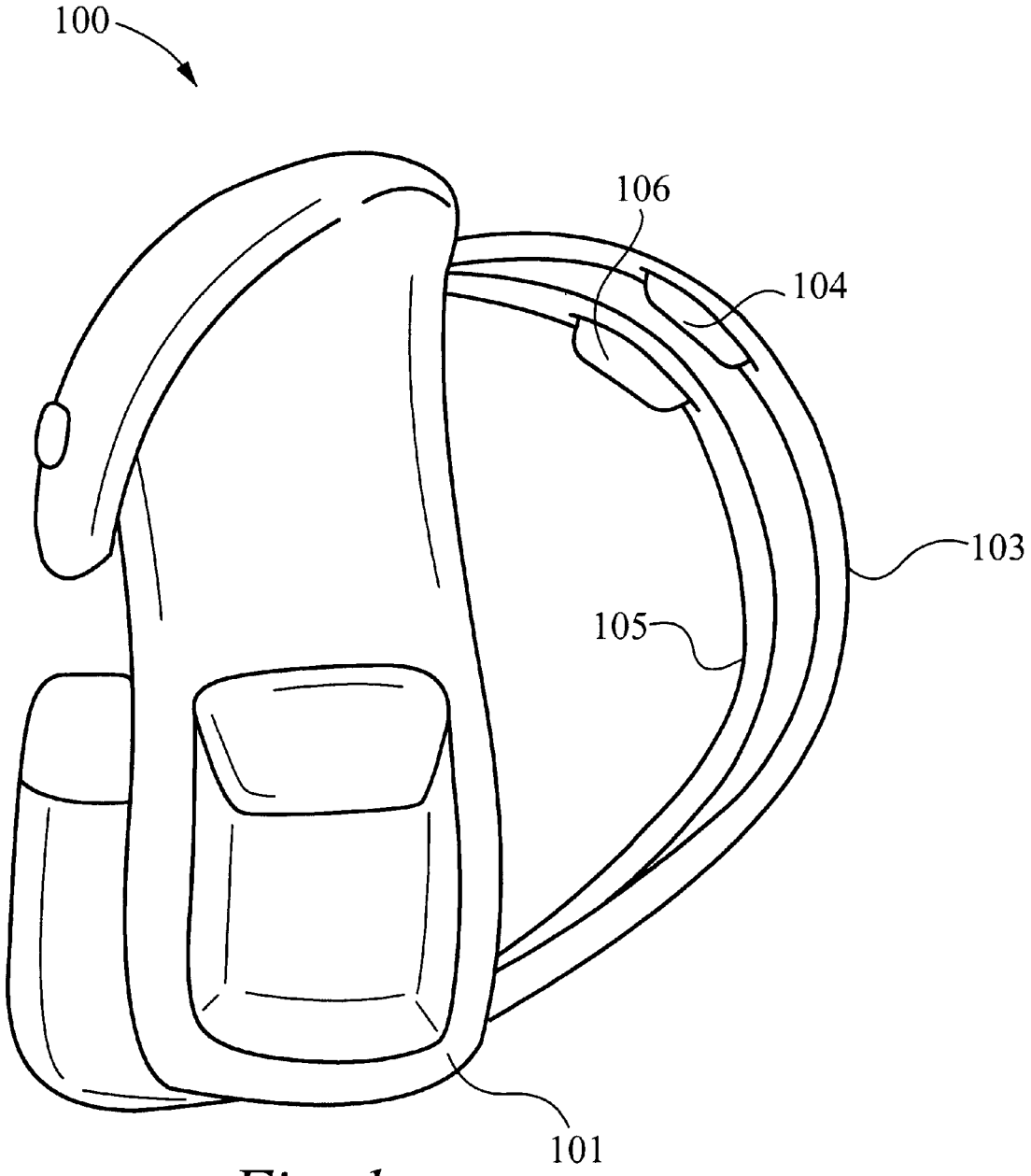
FIG. 1 shows a backpack with liquid container cushion sections on shoulder straps of the backpack, in accordance with the instant invention.

FIG. 1 shows a perspective view of a backpack 100 with fluid cushion sections 104 and 106, in accordance with the instant invention. The backpack 100 has a bag structure 101 coupled to shoulder straps 103 and 105 for carrying the backpack 100 from a user's shoulders.

The fluid cushions 104 and 106 preferably comprise a fluid sealed within a flexible container. The fluid cushions provide for even distribution of weight on the user's shoulders. Preferably, the fluid cushions 104 and 106 are configured to detachably couple to the straps 103 and 105 through clips, snaps and any other suitable attachment means. Alternatively, the fluid cushions 104 and 106 are integral with the straps 103 and 105, wherein the flexible containers are fixed into or under the fabric of the material forming the straps 103 and 105.

Figure 2:
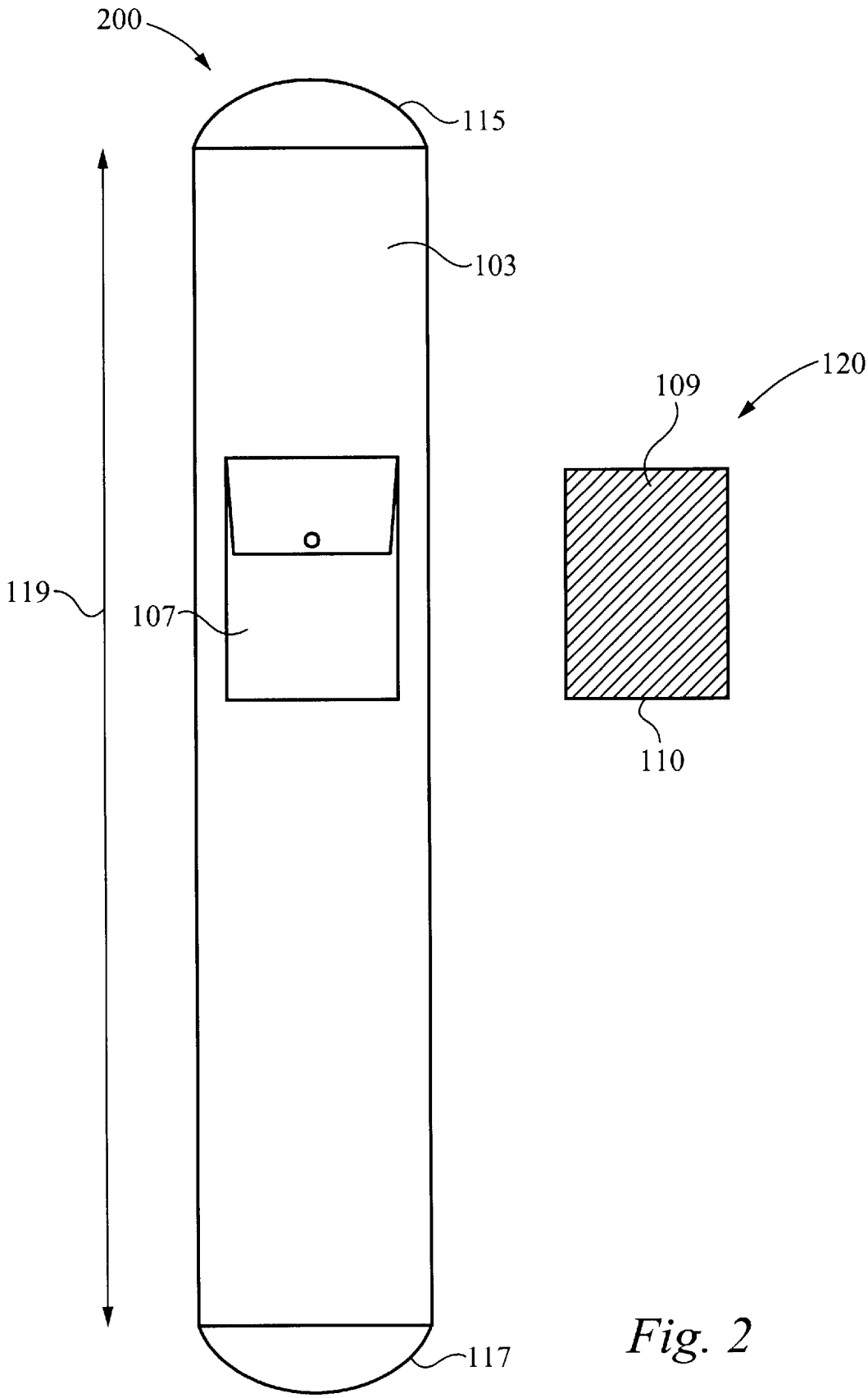
FIG. 2 shows a strap system with a removable gel-pack, in accordance with the instant invention.

Now referring to FIG. 2, a strap system 200 in accordance with the invention preferably comprises an elongated strap 103. The elongated strap 103 is permanently attached to a portable object or is configured to be detachably coupled to a portable object. The portable object is preferably a bag structure such as a backpack, a tote bag, brief case, a piece of luggage, a golf bag or a purse. Alternatively, the elongated strap 103 is a seat belt strap or other restraining and/or support strap. The system 200 of the instant invention can include a pair of attachment features 115 and 117 such as clips, loops or snaps for coupling to complementary clips, loops or snaps of a portable object.

Still referring to FIG. 2, the strap system 200 of the instant invention comprises a fluid container 120 that is securable to the elongated strap 103 in an elongation direction 119, such that the fluid container 120 will not slide up or down along the strap 103 during use. Accordingly, the strap is configured with a pocket feature 107. In use, the fluid container 120 is placed within the pocket or container feature 107 and secured therein to provide cushion to a contact region of the user's body. The pocket or container feature 107 is integral with the elongated strap 103 or, alternatively, is detachable from the strap 103. Other methods for securely and detachably coupling the fluid container 120 to the strap 103, such as at hook and loop fabric attachment mechanisms, are considered to be within the scope of the invention.

Still referring to FIG. 2, the fluid container 120 preferably comprises a fluid 109 that is sealed within a flexible membrane 110 formed form a suitable material including rubber, plastic or vinyl. The liquid 109 preferably has a viscosity in a range of 0.5 to 25,000 centa-poise (cP) and more preferably in a range of 50.0 to 20,000 centa-poise (cP). The fluid 109 is any suitable fluid, but is preferably a water-based ethylene glycol solution with a suitable preservative and coloring additive. Alternatively, the fluid is a gel comprising a silicon-based gel or other suitable suspension material. When the fluid container 120 comprises a liquid, a solution, a gel suspension or any combination thereof, sealed within the flexible membrane 110, the fluid container 120 is referred to herein as a gel-pack. The flexible membrane 110 forms a single fluid compartment, a plurality of fluid compartments or a network of fluid compartments, as described in detail below. In a preferred embodiment of the invention, the gel-pack 120 is supported through a support frame with exposed gel-pack surfaces on two opposite sides.

Figure 3A:
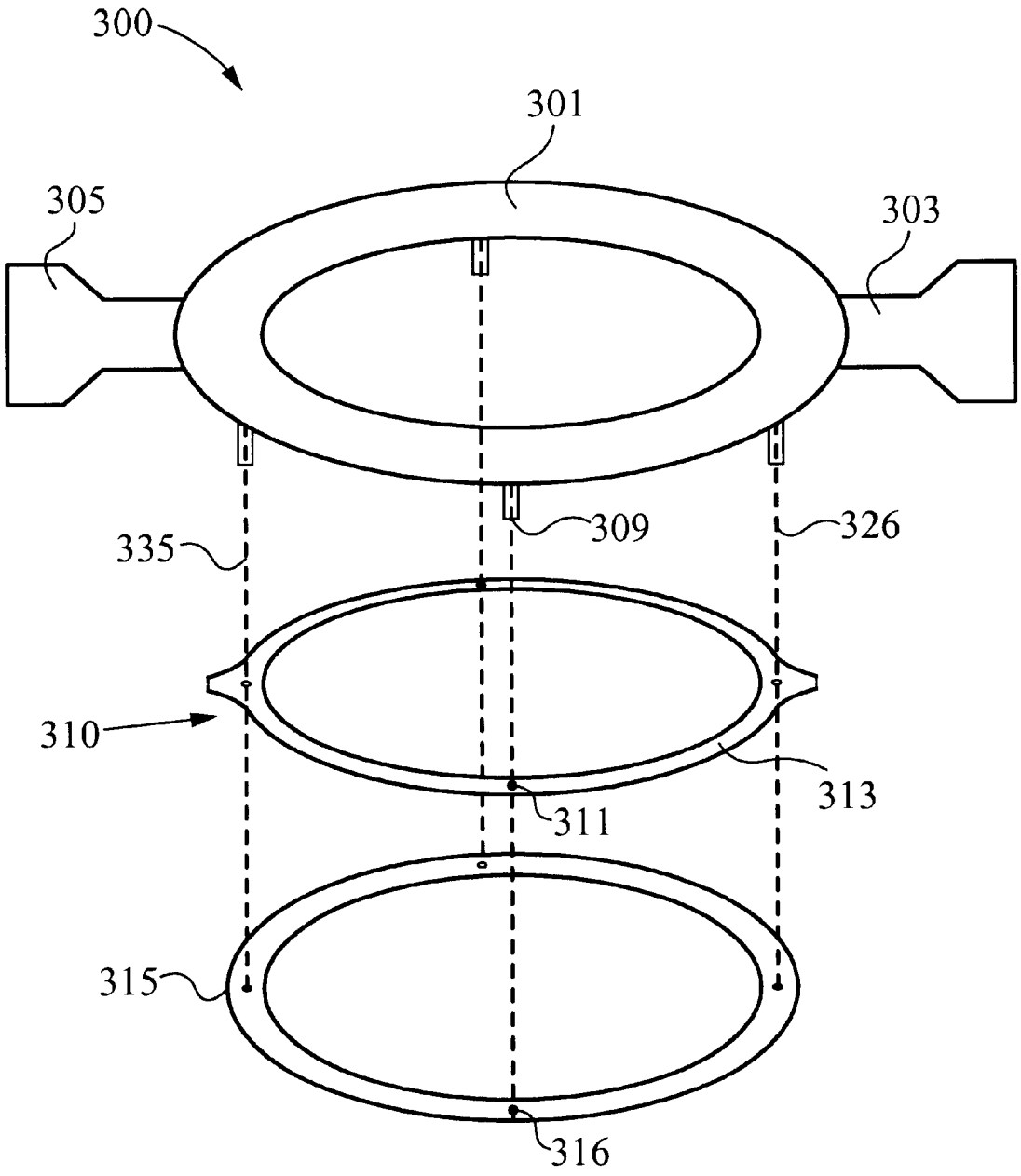
FIGS. 3*a–b* illustrate preferred methods for making and assembling cushion devices, in accordance with the instant invention.

Now referring to FIG. 3*a*, a cushion device 300 in accordance with the instant invention is formed from a first framing section 301, a complementary second framing section 315 and a gel-pack 310. The framing sections 301 and 315 are coupled as indicated by the dotted lines 326 and 335 such that a securing edge 313 of the gel-pack 310 is framed and held between the framing sections 310 and 315.

The framing section 301 is preferably configured with prong structures 309 which thread through apertures 311 along the securing edge 313 of the gel-pack 310 and fit into receiving apertures 316 on the second complementary framing section. The prong structures 309 rivet the gel-pack in position and hold the assembled frame sections 301 and 315 together. The framing section 301 is preferably configured with two attaching sections 303 and 305 for selectively and detachably coupling the assembled device to a strap. The prong structures 309 and the receiving apertures 311 can be formed on either of the framing sections 301 and 315 and in any number of combinations. For example, one attaching section 303 can be formed with the framing section 310, while the attaching section 305 is formed with the framing section 315. Also, the prong structures 309 and receiving apertures 316 can be formed on either or both of the framing sections 301 and 315. Further, it is understood that the frame sections 310 and 315 can be formed on any number of attaching sections suitable for the application at hand.

Figure 3B:
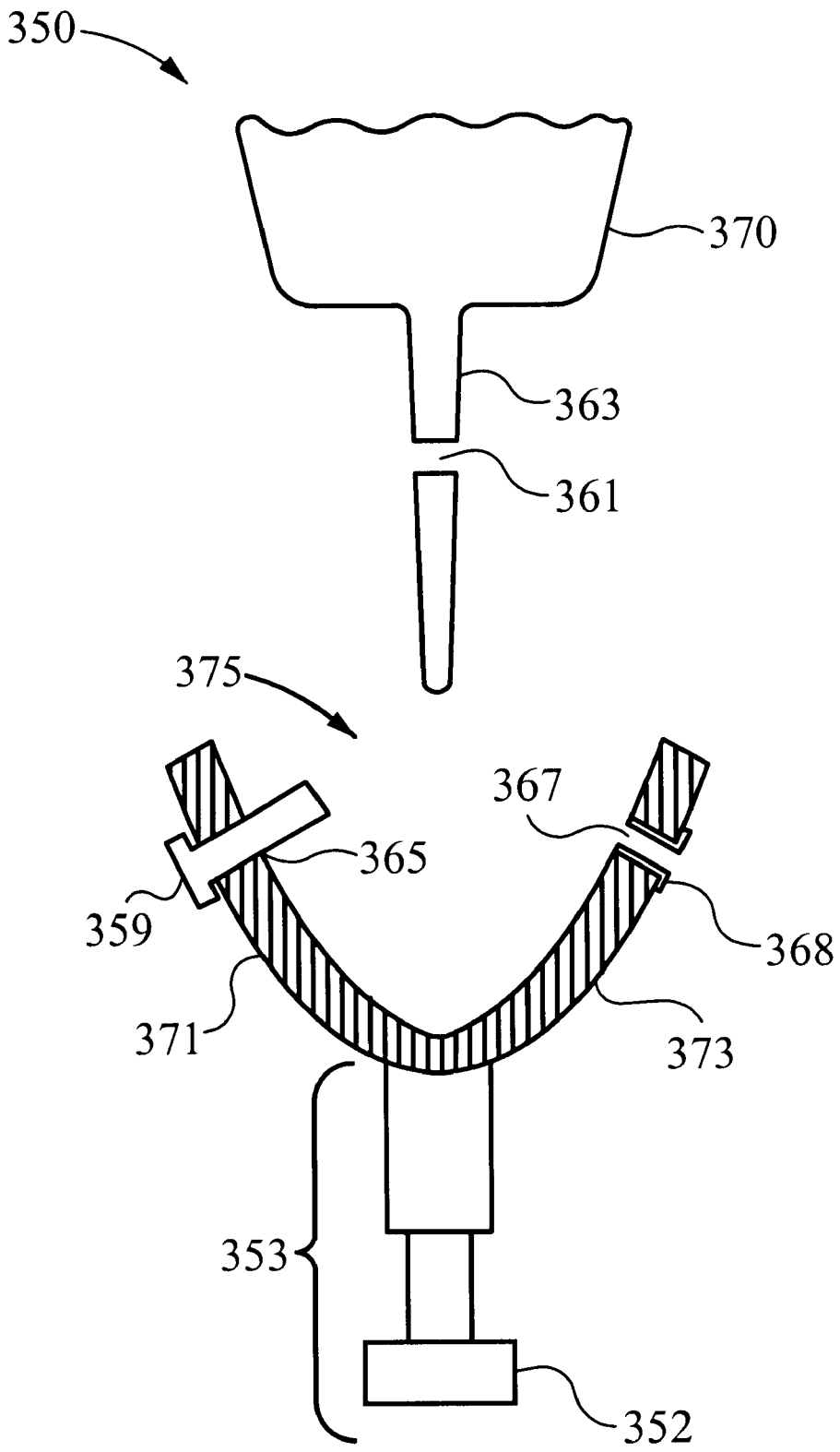

FIG. 3*b* shows a cross-sectional view 350 of a framing section 351 for framing a gel-pack 370, in accordance with the preferred embodiment of the instant invention. In accordance with this preferred embodiment, the frame section 351 frame is monolithic. The frame section 351 has a U-shaped framing groove 375 between two framing flaps 371 and 373. The framing flap 371 and the framing flap 373 have one or more receiving apertures 365 and 367. During assembly of the device, a sealing edge 363 of the gel-pack 370 to be framed is placed within the framing groove 375. Preferably the a plurality of pressure fitted rivet structures, similar to the rivet structure 359 illustrated in FIG. 3*b*, are used to helps to secure the gel-pack 370 within the frame section 351. The rivet structure 359 is formed from any suitable material, but is preferably formed from an acrylonitrile butadiene styrene resin (ABS). The rivet structure 359 is threaded from the aperture 365 through the apertures 361 on the sealing edge 363 of the gel pack 370 and into the aperture 367. Preferably, the aperture 367 has a female snap feature 368 to receive the rivet structure 359, wherein the rivet structure 359 snaps securely into the female snap feature 368 to secure the gel-pack 370 between the flaps 371 and 373. Alternatively, the gel-pack 370 is secured within the frame section 351 with glue or a combination of rivet structures and glue. Preferably, the framing section 351 is configured with an attaching section 353 comprising a clip 352 for selectively coupling the assembled device to a strap (not shown). Whether the support frame is formed in parts, as illustrated in FIG. 3*a*, or is monolithic, as illustrated in FIG. 3*b*, the frame structure is preferably formed from a resilient or pliable polymeric material such as plastic, polyurethane, or rubber. Most preferably the frame structure is formed from polyvinyl chloride (PVC) or a related material.

Figure 4A:
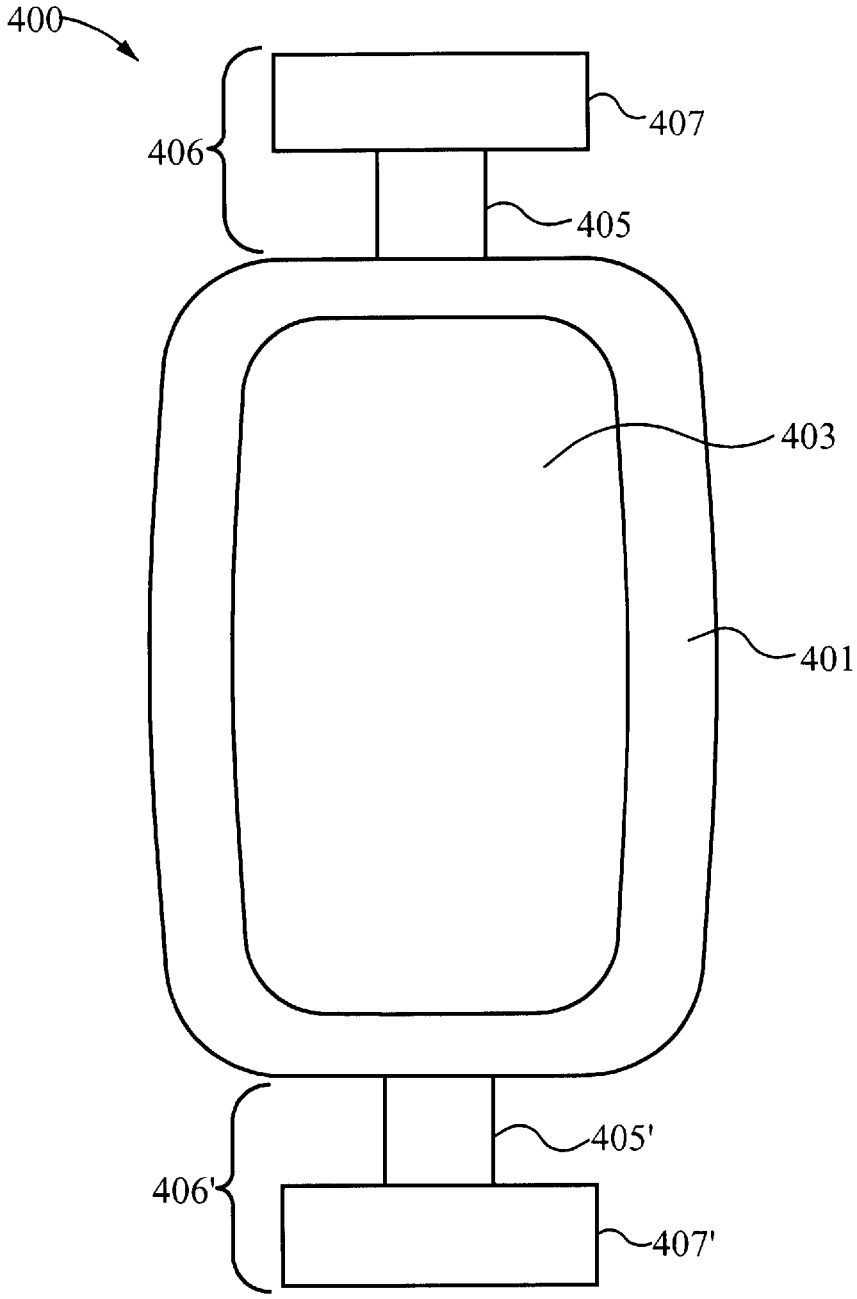
FIGS. 4*a–b* show a cushion device with attaching sections for selectively and detachably coupling to one or more straps.

FIG. 4*a* shows a cushion device 400 in accordance with the instant invention. The cushion device 400 has a cushion section 403 that preferably comprises a gel-pack. The gel-pack 403 is coupled to a support frame 401 with two attaching sections 406 and 406' at approximately opposite ends of the frame structure 401. The attaching sections 406 and 406' are configured for selectively and detachably coupling in an elongated direction of a strap (not shown). Each of the attaching sections 406 and 406' preferably has a clip section 407 and 407' comprising at least one clip for attaching to the strap.

In accordance with further embodiments of the invention, the clips sections 407 and 407' are attached to the frame 401 through bendable, pliable or expandable sections 405 and 405' which allow the clip sections 407 and 407' to conform to the strap in a variety of strap configurations. Further, the bendable, pliable or expandable sections 405 and 405' provide the pad section 403 a degree of mobility while remaining attached to the strap or belt. For example, the section 405 and 405' can be formed with a flexible material and/or with resilient accordion-like structures, which allows the gel-pack 403 to remain substantially in a position over a contact region of a user's body while the attached strap flexes or twists during use.

Figure 4B:
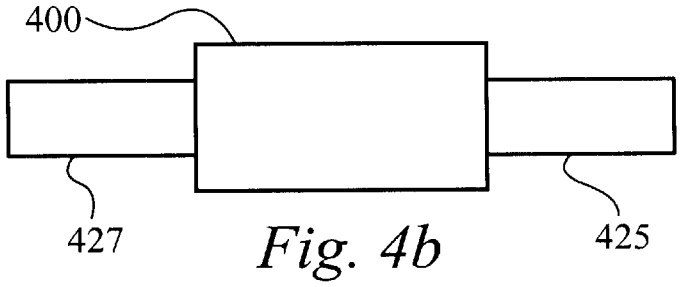

The cushion device 400 illustrated in FIG. 4*a* is coupled to a section of a strap by attaching to the strap in two or more positions, wherein the cushion is placed between the strap and a contact region of the user's body. Alternatively, the device 400 is configured to couple between end portions 425 and 427 of two or more straps, wherein the device provides a physical connection between the end portions 425 and 427 of the straps, as shown in FIG. 4*b*.

Figure 5:
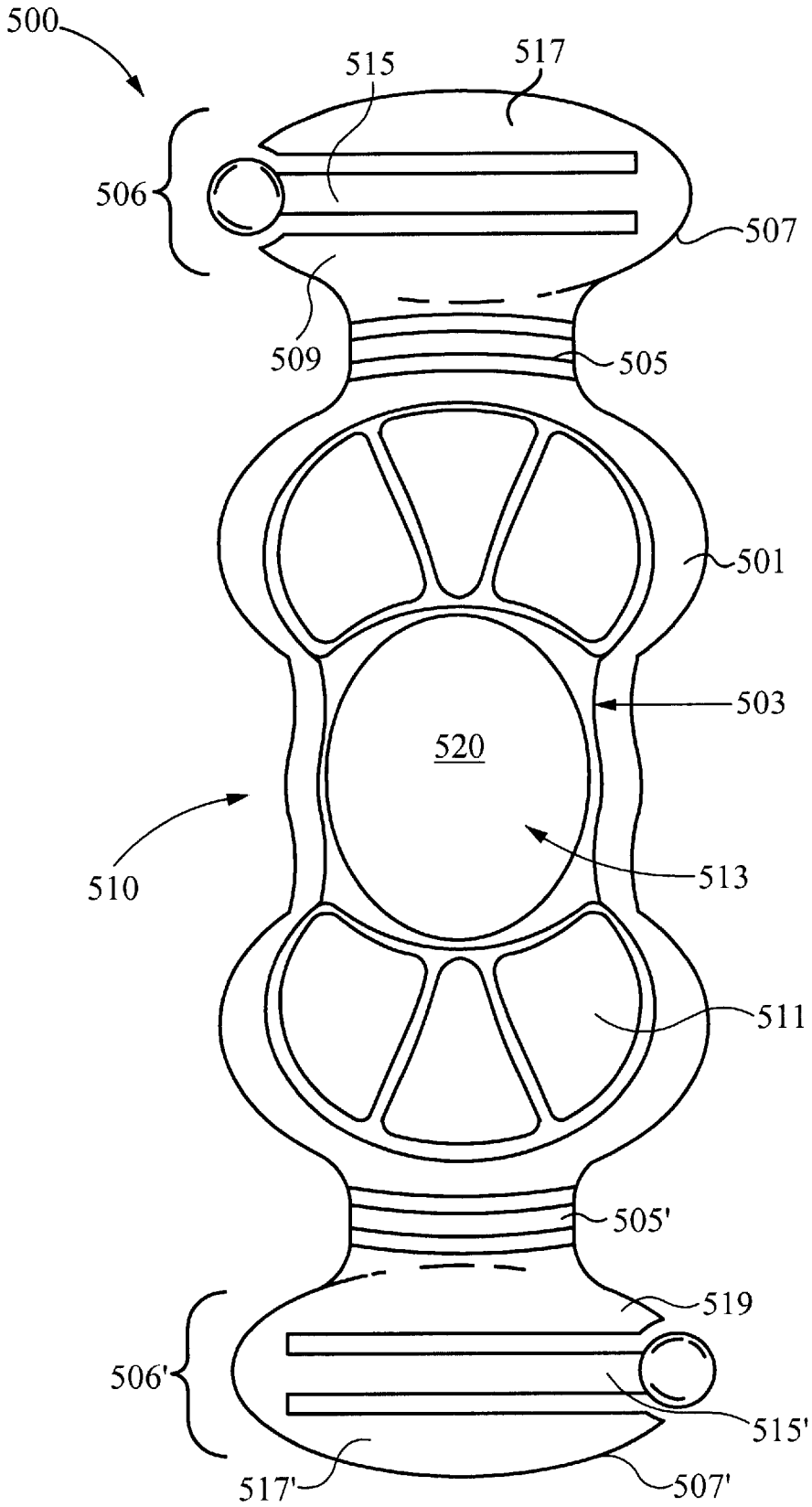
FIG. 5 shows a cushion device with a contoured cushion section and clips for selectively and detachably coupling to one or more straps.

FIG. 5 shows an alternative cushion device 500, in accordance with the instant invention. The device 500 has a fluid container that is preferably a gel-pack 503. The gel pack 103 is formed form a contoured flexible membrane with a plurality of protruding regions 511 and 513. The protruding regions 511 and 513 correspond gel compartments 511 and 513 which are isolated gel compartments or are, alternatively, networked gel compartments, wherein gel flows between the regions 511 and 513 as required to evenly distribute a load over a contact region of a user's body. The contoured membrane of the gel-pack 503 is formed from clear or colored resilient flexible material such as a rubber, plastic, vinyl and the like.

Still referring to FIG. 5, the gel-pack is preferably held within a support frame 501 such that surfaces of the gel-pack 503 are exposed on both sides 513 and 510 of the device 500. The support frame 501 is preferably coupled to the clip sections 506 and 506' with the clips 507 and 507' for coupling the device 500 to a selected region of a strap.

In accordance with further embodiments of the instant invention, the clips 507 and 507' are slide clips, wherein the device 500 is coupled to the strap by sliding the strap into the slots of each of the clips 507 and 507'. A knob or bulbous structure on an end of the center prongs 515 and 515', or alternatively on the ends of one or more sets of outer prongs 517/517' and 519/519' help hold the device 500 in the preferred position on the strap. The clips 507 and 507' are preferably attached to the frame 501 through bendable, pliable or expandable sections 505 and 505' as described above.

Figure 6A:
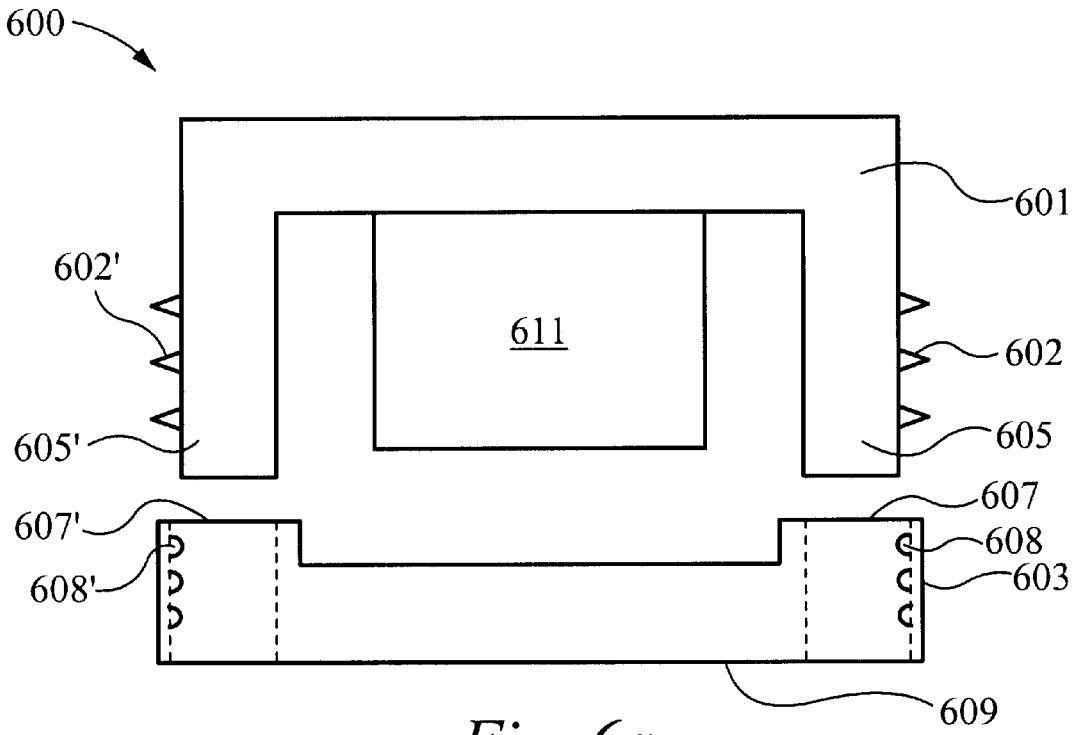
FIGS. 6*a–b* show clip structures for clasping a cushion device to one or more straps, in accordance with a preferred embodiment of the instant invention.

FIG. 6*a* shows a clip structure 600 in accordance with the instant invention. The clip structure 600 comprises a first clip part 601. The first clip part 601 has arm structures 605 and 605' with one or more corrugated edges 602 and 602'. The second clip part 603 is preferably coupled to a gel-pack and a support frame by a clip surface 609, described in detail above. The second clip part 603 has receiving apertures 607 and 607' that preferably extend through a portion of the second clip part 603, as indicated by the dotted lines. The receiving apertures 607 and 607' are configured to receive the arm structures 605 and 605'. In use a strap is placed between the first clip part 601 and the second clip part 603. The arm structures 605 and 605' are placed within the receiving apertures 607 and 607'. The corrugated edges 602 and 602' of the arm features 605 and 605' rachet into the receiving apertures 607 and 607' and secure the strap between the first clip part 601 and the second clip part 603. The second clip part 603 has protruding features 608 and 608' within the apertures 607 and 607' to help secured the clip 600 in a closed position. Further, the first clip part 601 is configured with a protruding structure 611 to help secure the strap between the first clip part 601 and the second clip part 603 with the clip in the closed position.

Figure 6B:
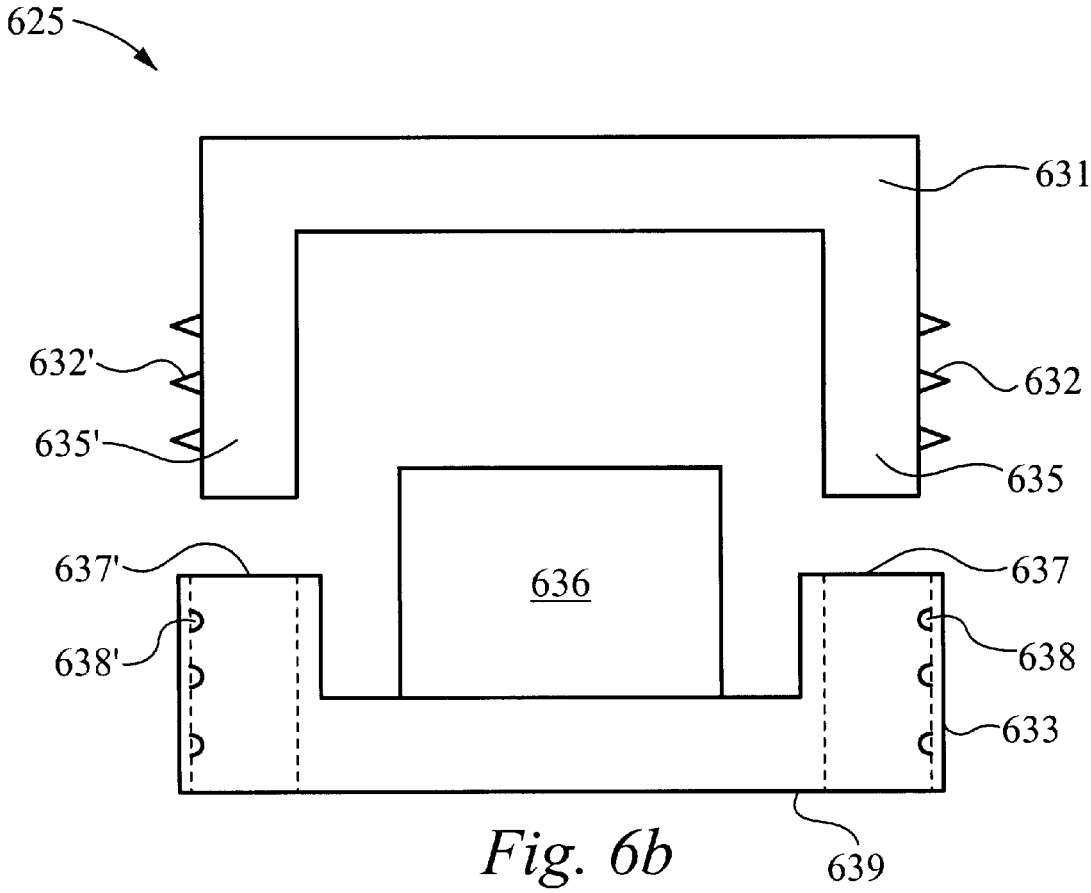

FIG. 6*b* illustrates a clip structure 625 in accordance with a preferred embodiment of the instant invention. The clip structure 625 comprises a first clip part 631 with arm structures 635 and 635' having one or more corrugated edges 632 and 632'. A second clip part 633 is preferably coupled to the gel-pack and frame by a clip surface 639, as described previously. The second clip part 633 has receiving apertures 637 and 637' for receiving the arm structures 635 and 635'. As with the clip structure 600 shown in FIG. 6*a*, a strap is placed between the first clip part 631 and the second clip part 633 and the arm structures 635 and 635' are inserted into the receiving apertures 637 and 637'. The corrugated edge 632 and 632' of the arm structures 635 and 635' rachet into the apertures 637 and 637', thereby securing the clip structure 625 in a closed position with the strap therebetween. The receiving apertures 637 and 637' has protruding surfaces 638 and 638' within the apertures 637 and 637' to help secure the clip in the closed position. Further, the second clip part 633 is configured with a protruding structure 636 to help secure the strap between the first clip part 631 and the second clip part 633 with the clip in the closed position. The clips can be made from any suitable material but is preferably the first clip parts 601 and 631 are formed from a harder plastic material, while the second clip parts 603 and 633 are formed from a softer pliable plastic or rubber.

Figure 7A:
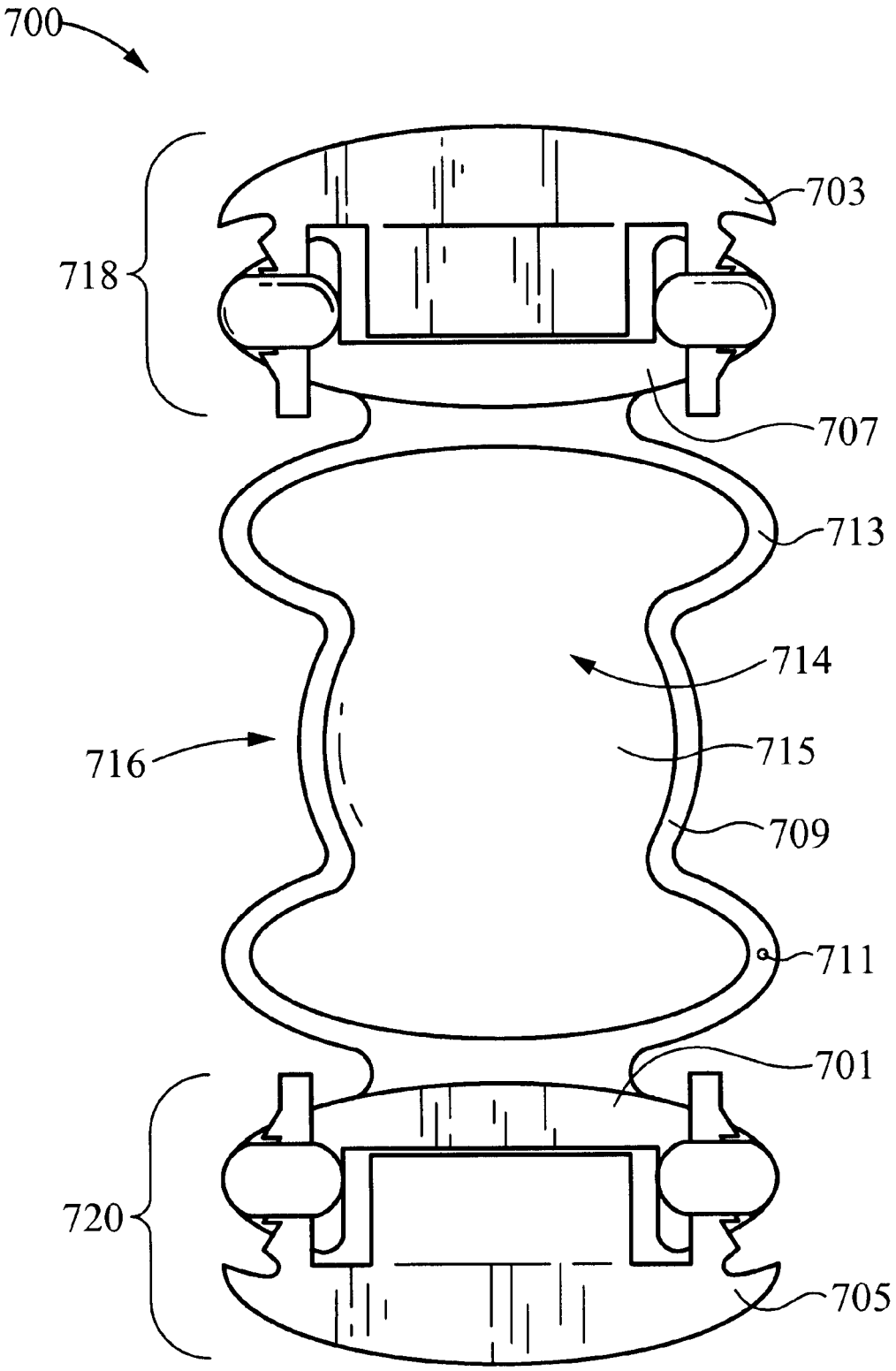
FIGS. 7*a–b* show a use of the cushion device, in accordance with preferred embodiments of the instant invention.

FIG. 7*a* shows a cushion device 700 in accordance with a preferred embodiment of the instant invention. The device 700 comprises a gel-pack 715 held within a support frame 713. The support frame 713 is preferably shaped to be substantially similar to the shape of the gel-pack 715. The gel-pack 715 is held within a framing region 713 through a framing grove, framing flaps or combinations thereof. Preferably, the gel-pack 715 is secured within the frame 713 such that the gel pack 715 has exposed front surfaces 714 and exposed back surfaces 716 (not shown). The device 700 preferably comprises plastic or rubber rivets which secure the gel-pack 715 within the frame 713 through the framing region 709, as described previously.

Still referring to FIG. 7*a*, the device 700 preferably has two clips 718 and 720, that are preferably two-part clips. The first parts 703 and 705 of the two part clips 718 and 720 preferably rachet into the second parts 707 and 701 of the two-part clips 718 and 720, similar to those described previously.

Figure 7B:
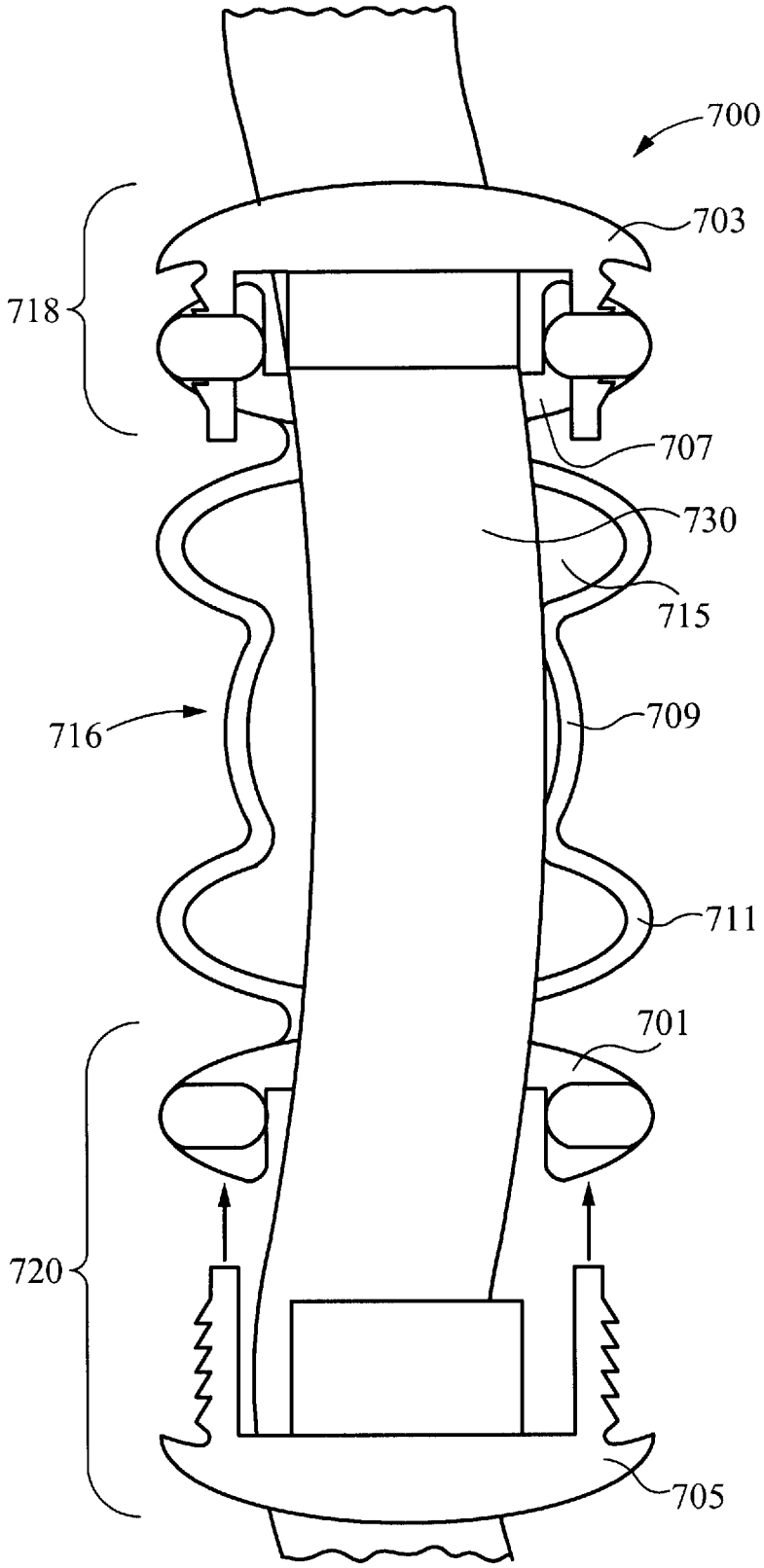

FIG. 7*b* shows a preferred method of use for the cushion device 700, shown in FIG. 7*a*. The first parts 703 and 705 of the clips 718 and 720 are separated from the second parts 707 and 701 of the clips 718 and 720. A strap 730 is placed between the first parts 703 and 705 and the and the second parts 707 and 701 and the clips 718 and 720 are reassembled to closed positions. After the cushion is coupled to a selected portion of the strap 730, then the cushion 700 device is placed over a contact region of the user's body with a cushion surface 716 of the device 700 against the contact portion of the user's body.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications can be made in the embodiment chosen for illustration without departing from the spirit and scope of the invention. Specifically, a fluid container utilized in the system and device of the instant invention can be configured with any number of gel-pack shapes, sizes and colors. Further, the gel-pack can include small toys, trinkets, memorabilia sparkle material or any other material sealed within the flexible membrane of the gel-pack which adds to the appearance and/or function of the cushion device. The cushion device of the instant invention can have any number of clip designs suitable for detachably and selectively coupling the cushion device to one or more straps and the frame structure of the cushion device can include integrated or detachable accessories such as lighting features.

What is claimed is:

1. A system comprising:

a. at least one strap member, the strap member being elongated in an elongation direction and configured for bearing a load; and b. a cushion member comprising two attaching sections configured to selectively attach to the strap member in the elongated direction for distributing the load onto a portion of a user's body, wherein the cushion member is configured to be detachably securable to the at least one strap member through a plurality of clips.

2. The system of claim 1, wherein the cushion member is securable to the at least one strap member through a pocket that is integrally formed on the at least one strap.

3. The system of claim 1, wherein each of the plurality clips comprises two-parts configured to clasp around the at least one strap.

4. The system of claim 1, wherein the at least one strap member is configured to carry an object.

5. The system of claim 4, wherein the at least one strap member is configured to be detachably coupled to the object.

6. The system of claim 5, wherein the object is a bag structure.

7. The system of claim 6, wherein the bag structure is selected from the group consisting of a backpack, a tote bag, a brief case a piece of luggage, a golf bag and a purse.

8. The system of claim 1, wherein the cushion member comprises a fluid sealed within a membrane.

9. The system of claim 8, wherein the membrane comprises a plurality of fluid compartments.

10. The system of claim 8, wherein the fluid has a viscosity in a range of 0.5 to 25,000 centa-poise (cP).

11. The system of claim 10, wherein the fluid is a solution comprising ethylene glycol.

12. The system of claim 11, wherein the fluid comprises a silicon-based material.

13. A device comprising:

a. a cushion section, wherein the cushion section comprises a gel-pack comprising a fluid encapsulated within a flexible membrane and the cushion section further comprises a frame structure for supporting the flexible membrane; and b. means for selectively and detachably securing the cushion section to a strap, wherein the means for selectively an detachably securing the cushion section to the strap comprising two attaching sections.

14. The device of claim 13, wherein the fluid is colored.

15. The device of claim 13, wherein the fluid has a viscosity in a range of 0.5 to 25,000 centa-poise (cP).

16. The device of claim 13, wherein the flexible membrane is contoured into a plurality of cushion sections.

17. The device of claim 13, wherein the flexible membrane is colored.

18. The device of claim 13, wherein the flexible membrane is formed from a material selected from the group consisting of rubber, plastic and vinyl.

19. The device of claim 13, wherein the frame structure includes a framing groove for coupling to a securing edge around the flexible membrane.

20. The device of claim 19, wherein the frame structure comprises a plurality of prong features which thread through the securing edge of the flexible membrane.

21. The device of claim 13, wherein the means for selectively and detachably securing the cushion section comprises two attaching sections coupled to the frame structure.

22. The device of claim 21, wherein at least one of the two attaching sections is flexible.

23. The device of claim 21, wherein each of the two attaching sections comprise a clip.

24. The device of claim 23, wherein the clip is a two-slot three prong slide clip.

25. The device of claim 23, wherein the clip comprises an arm structure with a corrugated edge and a receiving aperture, wherein the arm structure inserts onto the receiving aperture and the corrugated edge ratchets into the receiving aperture to clasp the strap.

26. A method of making a cushion device comprising:

a. forming a gel-pack with a securing edge; and b. forming a frame comprising a framing region configured to receive the securing edge of the gel-pack; and c. framing the gel-pack within the frame such that the securing edge of the gel-pack is secured to the framing region.

27. The method of claim 26, wherein the framing region comprises a framing groove between two flaps, wherein the securing edge of the gel-pack is secured between the two flaps.

28. The method of claim 27, wherein the framing region comprises prong features that couple to the two flaps and which thread through the securing edge of the gel-pack.

29. A device comprising:

a. a container for holding a cushion material;

b. a frame structure; and c. means for selectively and detachably securing the container to a strap, wherein the means for selectively and detachably securing the container comprises two attaching sections coupled to the frame structure.

30. The device of claim 29, wherein the container is configured to hold a fluid cushion material.

31. The device of claim 29, wherein the container comprises a flexible membrane.

32. The device of claim 29, wherein each of the two attaching sections comprise a clip.

33. The device of claim 32, wherein at least one of the two attaching sections is flexible.

34. The device of claim 32, the clip is a two-slot three prong slide clip.

35. The device of claim 32, wherein the clip comprises an arm structure with a corrugated edge and a receiving aperture, wherein the arm structure inserts onto the receiving aperture and the corrugated edge ratchets into the receiving aperture to clasp the strap.

36. A device comprising:

a. a cushion;

b. a frame structure for supporting the cushion; and c. means for selective and detachably securing the cushion to a strap, wherein the means for selectively and detachably securing the cushion comprises a first clip and a second clip.

37. The device of claim 36, wherein the first clip and the second clip are coupled to the cushion through a first and a second flexible attaching sections.

38. The device of claim 36, herein cushion comprises a container.

39. The device of claim 38, wherein the container further comprises a fluid.

40. The device of claim 38, wherein the container is a flexible membrane.

* * * * *